United States Patent [19]

Niitsu et al.

[11] 4,370,013

[45] Jan. 25, 1983

[54] CONNECTOR DEVICE FOR ELECTRIC CIRCUIT

[75] Inventors: Mitsugi Niitsu, Niiza; Shuichi Yamazaki, Kami-Fukuoka; Shigeru Kimura, Kamakura, all of Japan

[73] Assignees: Honda Giken Kogyo Kabushiki Kaisha, Tokyo; Nifco, Inc., Yokohama, both of Japan

[21] Appl. No.: 183,063

[22] Filed: Sep. 2, 1980

[30] Foreign Application Priority Data

Sep. 5, 1979 [JP] Japan ..... 54/121728[U]

[51] Int. Cl.[3] ..... H01R 13/631

[52] U.S. Cl. ..... 339/82; 339/91 R

[58] Field of Search ..... 339/82, 91 R, 91 P; 235/82, 84; 24/211 L, 213 R, 230 AK, 255 SL, 260, 241 SL, 241 S, 236, 237

[56] References Cited

U.S. PATENT DOCUMENTS 3,467,942 9/1969 Dell et al. ..... 339/91 R
3,713,076 1/1973 Gabrielian et al. ..... 339/91 R

FOREIGN PATENT DOCUMENTS 642850 5/1964 Belgium ..... 339/91 R
1491731 7/1967 France ..... 339/91 R

*Primary Examiner*—John McQuade
*Attorney, Agent, or Firm*—Trexler, Bushnell & Wolters, Ltd.

[57] ABSTRACT

A connector device comprising female and male connector housings and a lock means, one of the connector housings being provided with a resilient tongue piece possessing a check claw and the other connector housing being provided with a crosspiece adapted to receive the check claw into fast engagement and the lock means being provided with an insertion piece possessing a check means. After the paired connector housings have been fastened to each other and the check claw of the resilient tongue piece has been brought into fast engagement with the crosspiece to establish electric continuity between the opposed terminals incorporated within the connector housings, the insertion piece possessing the check means is inserted into the space formed below the resilient tongue piece and the check means is brought into fast engagement with the support legs of the crosspiece. Consequently, the resilient tongue piece is prevented from being bent downwardly, with the result that the two connector housings become inseparable and the insertion piece becomes substantially inseparable. The connector device, therefore, keeps the two connector housings sealed in their fastened state.

12 Claims, 10 Drawing Figures

Fig_1
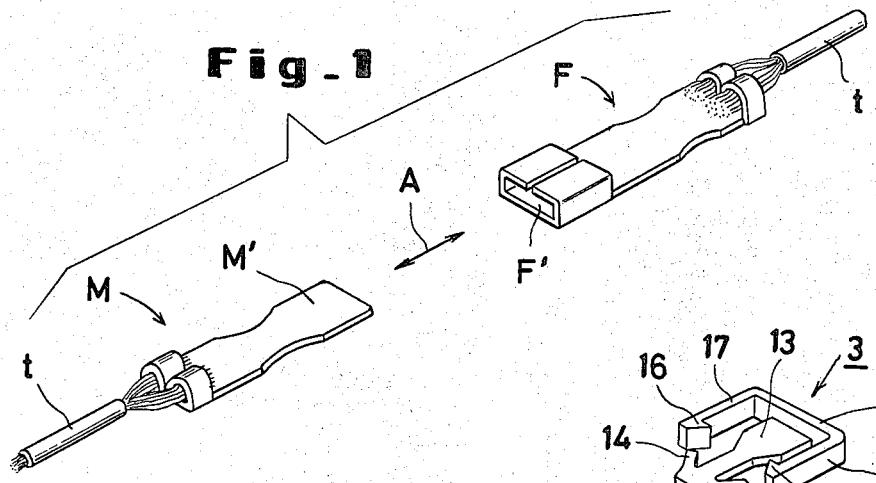
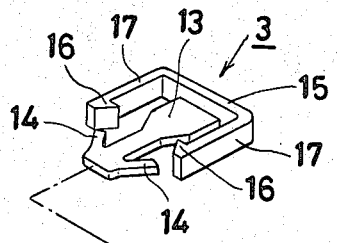
Fig_2
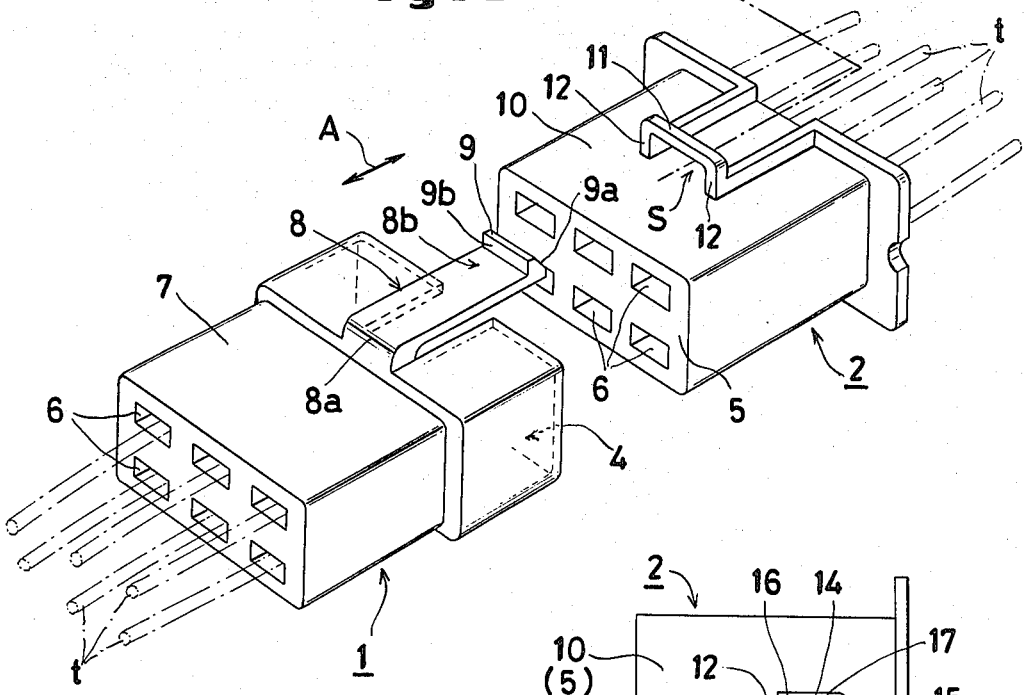
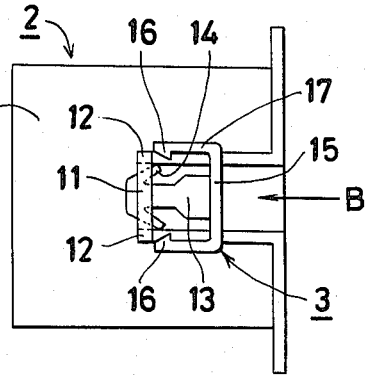
Fig_5

Fig-6
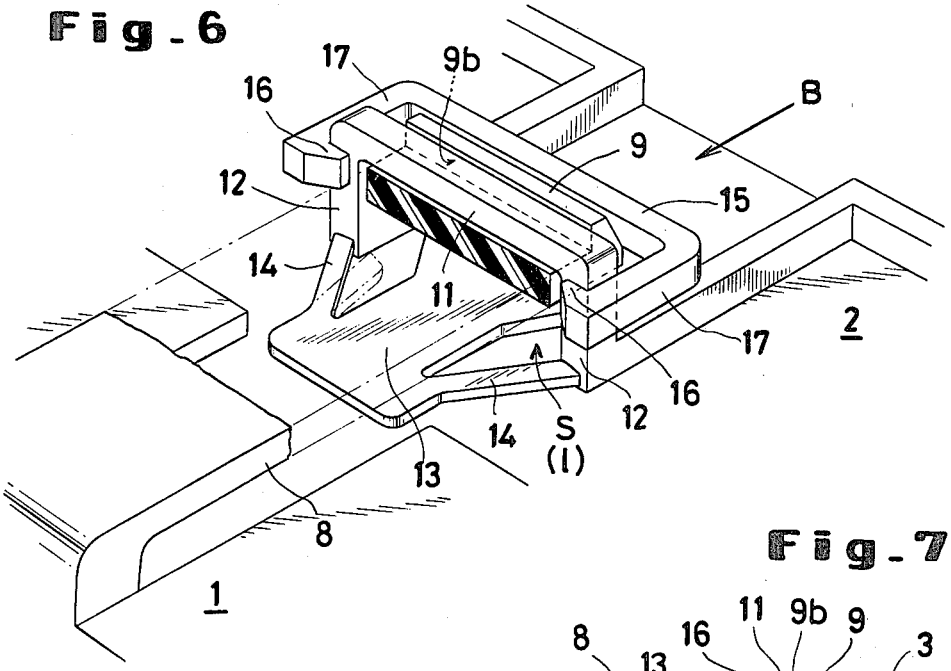
Fig-7
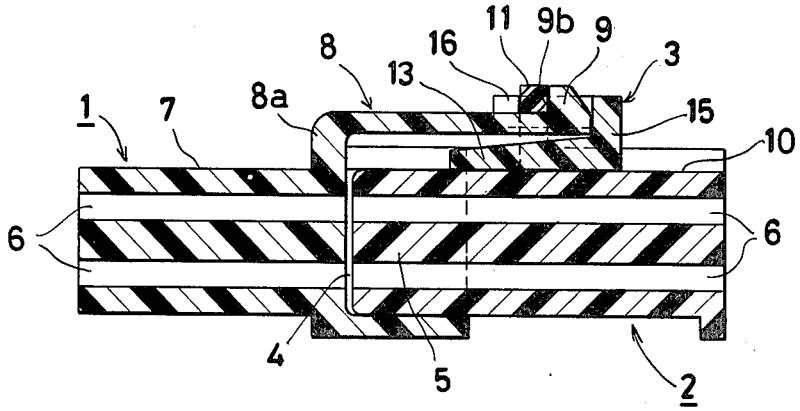
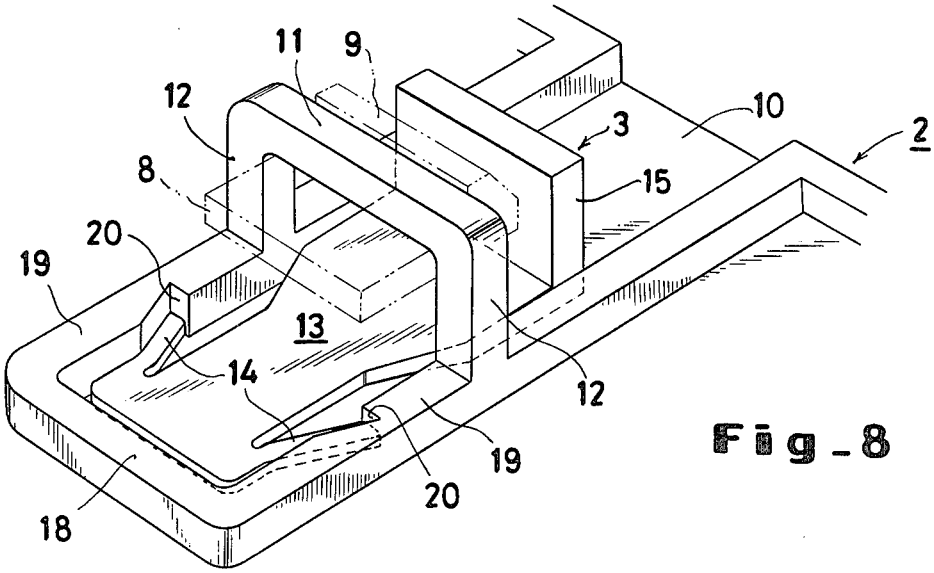
Fig-8

CONNECTOR DEVICE FOR ELECTRIC CIRCUIT

BACKGROUND OF THE INVENTION

This invention relates to a connector device comprising female and male connector housings of insulating material respectively incorporating female and male connector terminals of conducting material, which female and male connector terminals are adapted so that they complete joined electric circuits on being brought into mutual engagement, and more particularly to a connector device such that once the female and male connector housings are bound with each other and the female and male connector terminals are consequently joined to each other, their separation is extremely difficult.

In the conventional connector, electric continuity between a pair of conductors has been accomplished by electrically and mechanically fastening a male terminal to the leading end of one of the conductors and a female terminal to that of the other conductor respectively either by soldering or compression bonding and thereafter forcibly inserting the male terminal into the female terminal. Numerous connector devices have been proposed in which the male and female terminals are disposed within housings of insulating material so as to protect the connectors against mechanical troubles and eliminate all possibilities of human accidents.

Although these connector devices vary widely in many respects, what applies in common to them all is the fact that separation of the male terminals from their respective female terminals is accomplished relatively easily. This is quite natural in consideration of the nature of connectors. There are, however, times when the female and male connector housings are desired to be bound to each other so that their separation is extremely difficult and substantially impossible. For example, in some portions of the circuits in the electrical system of an automobile, use may be found for a connector device adapted for such inseparable fastening of connector housings. In the case of a connector device which permits free separation of the connector housings, when the owner of the automobile separates the connector housings from their union while modifying or repairing the circuits, the automobile manufacturer has no way to know this fact. If the automobile in question happens to develop a trouble from some defect in the electrical system, therefore, there may be times when no definite judgment can be drawn as to whether the responsibility for the trouble should be assumed by the owner or the manufacturer. In such portions, it is appropriate to use a connector device so designed that the connector housings thereof, on being fastened to each other, separate with extreme difficulty and, if forcibly separated at all, sustain breakage at some part or other of the housings. In the sense that this connector device retains the aforementioned breakage as a clear sign that such force separation has been made on the connector housings, it fulfills an additional function of sealing the connector device in its fastened state.

For use in a circuit such that accidental breakage of electric continuity possibly brings about a serious consequence, the connector device is required to retain the connector housings in a tightly fastened state even when it is exposed accidentally or deliberately to a fairly large external force, if not expected to possess the function of sealing the connector housings in their fastened state.

SUMMARY OF THE INVENTION

This invention has been accomplished with a view to fulfilling the requirement mentioned above. An object of this invention, therefore, is to provide a connector device so designed that the female and male connector housings thereof can be fastened to each other in the form of snapping engagement and, once so fastened, they separate from each other with extreme difficulty.

To accomplish the object described above according to the present invention, there is provided a connector device for electric circuits, which comprises female and male connector housings of insulating material, one of the connector housings being provided with a resilient tongue piece possessing a check claw and the other connector housing being provided with a crosspiece adapted to catch hold of the aforementioned check claw, and an insertion piece possessing a check means and adapted to be inserted in the space to be formed below the aforementioned resilient tongue piece after the two connector housings have been electrically and mechanically connected by having the check claw of the resilient tongue piece brought into hooked engagement with the aforementioned crosspiece, whereby the aforementioned insertion piece, on being set in position in the aforementioned space and fastened inseparably to at least one of the connector housings, serves to prevent the resilient tongue piece from being bent downwardly and render separation of the female and male connector housings no longer possible. Thus, the connector device of the present invention additionally fulfills a substantial function of sealing the connector housings in their fastened state. The other objects and characteristics of the present invention will become apparent from the further disclosure of the invention to be made hereinafter with reference to the accompanying drawing.

BRIEF DESCRIPTION OF THE DRAWING

FIG. 1 is a perspective view of typical connector terminals which are incorporated in an ordinary connector device.

FIG. 2 is a perspective view of the first embodiment of the connector device according to the present invention.

FIG. 5 is a plan view illustrating the bound relation between one of the connector housings and the locking means in the connector device of the present invention.

FIG. 6 is a partially cutaway, enlarged perspective view of the essential part of the connector device of this invention, illustrating the condition which is assumed after the two connector housings have been fastened to each other and the lock means has been set in position in the portion of snapping engagement.

FIG. 7 is a longitudinally sectioned view of the connector device as held in the condition of FIG. 6.

FIG. 8 is an enlarged perspective view of the essential part of the second embodiment of the connector device according to the present invention.

DESCRIPTION OF THE PREFERRED EMBODIMENT

Figure 3A:
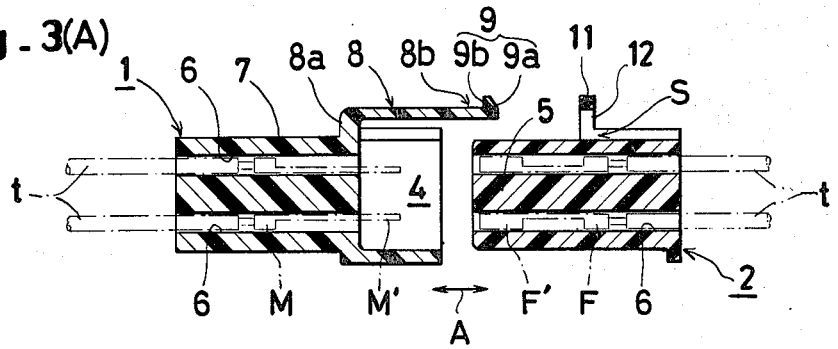
FIGS. 3(A), 3(B) and 3(C) are longitudinally sectioned views illustrating the successive steps of a procedure followed in fastening the female and male connector housings of the connector device of FIG. 2.

FIG. 1 illustrates a known connector which comprises a male terminal "M" and a female terminal "F". The leading end of one of the paired conductors "t" is connected to the male terminal "M" and that of the other conductor to the female terminal "F" both electrically and mechanically such as by compression bonding or soldering and the projecting portion "M'" of the male terminal "M" is forcibly inserted into the receiving portion "F'" of the female terminal "F" to establish electric continuity between the paired conductors. This method of conductor connection is adopted in numerous fields.

When the two terminals "M", "F" are both in an exposed state as illustrated in FIG. 1, there is a possibility that they will come into accidental contact with other circuits. To preclude such an accident the terminals "M", "F" are encased respectively in female and male housings of insulating material so that the terminals are exposed only in the portions "M'" and "F'" adapted for mutual engagement. In this arrangement, the engaging portions "M'", "F'" of the two terminals come into mutual engagement when the two housings are fastened to each other and, once this condition is assumed, the two terminals "M", "F" are wholly concealed within the joined housings. Numerous connector devices based on this general principle have been suggested to date. These conventional connectors permit ready separation of their male and female terminals.

FIG. 2 illustrates the first embodiment of the connector device of this invention in an exploded perspective view. This connector device comprises a female connector housing 1, a male connector housing 2 and a lock means 3 adapted to preclude otherwise possible separation of the two connector housings from their mutually fastened state. All of the above mentioned components are made of a suitable plastic material.

The female and male connector housings 1, 2 may be in one of many well known constructions. In the present embodiment, they are so constructed that, as is plain from the diagrams of FIG. 3, they are fastened to each other by having a leading end 5 of the male connector housing 2 inserted into a hollow portion 4 of the female connector housing 1 and brought into engagement by the means of snapping engagement to be described fully afterward. The overall shape of the connector device may be selected so as to have a rectangular cross section, for example.

The two housings 1, 2 respectively contain proper female and male connector terminals "M", "F" of the known art as illustrated in FIG. 1. Since the manner of the embodiment of the terminals and other matters of that sort have no direct bearing upon the present invention, a typical embodiment of terminals is shown in FIG. 3(A). Besides, perforations 6 intended to receive terminals are shown elsewhere in the drawing. Generally, as illustrated in FIG. 3(A), the male terminal "M" may be buried within the perforations 6 in the female housing 1 so as to permit its projecting portions "M'" to thrust into the hollow portion 4, while the female terminal "F" may be buried within the perforations 6 in the male housing 2 so as to permit its receiving portions "F'" to fall close to the leading end 5 of the male housing.

In the present illustrated embodiment, six perforations 6 for accommodating terminals are formed in matched positions in the two housings 1, 2 so as to provide simultaneous connection between six pairs of terminals. The number of such perforations and consequently the number of pairs of terminals to be connected are purely matters to be left to free choice.

The portions for snapping engagement of the male and female housings 1, 2 are constructed as described below.

On one outer surface, specifically on the upper surface 7 in the illustrated embodiment, the female housing is provided with a resilient tongue piece 8 having one end 8*a* fixed on the upper surface 7 and a leading end 8*b* extended to a free end in the axial direction in which the male housing 2 is inserted (the direction of the arrow "A"). Consequently, the resilient tongue piece 8 is allowed to be bent perpendicularly to the axial direction of the housing (in the vertical direction in the illustrated embodiment) with the fixed end 8*a* as the fulcrum. At the free end 8*b*, the resilient tongue piece 8 is provided with a protuberance 9 having an axially leading surface 9*a* thereof abruptly inclined upwardly toward the fixed end 8*a* and a rear surface 9*b* thereof inclined backwardly in the axial direction so that the two surfaces converge in the upward direction. This protuberance 9 serves as a check claw.

On the other hand, the male housing 2 is provided on the corresponding upper surface 10 thereof with a crosspiece 11 at a position where the crosspiece 11 comes into engagement with the rear surface 9*b* of the check claw 9 when the male housing is inserted into the hollow portion 4 of the female housing 1. This crosspiece 11 is held at a certain height by supporting legs 12 rising and joining into the opposite ends of the crosspiece. Because of the supporting legs 12, a space "S" is formed between the crosspiece 11 and the upper surface 10 of the housing 2. The height of the crosspiece and the size of the space "S" are fixed so as to meet the condition under which the successive steps of the procedure followed in fastening the two housings are effected as described below.

Figure 3:
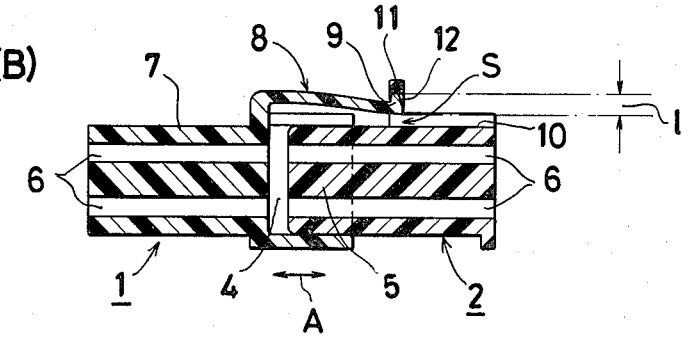
Figure 3:
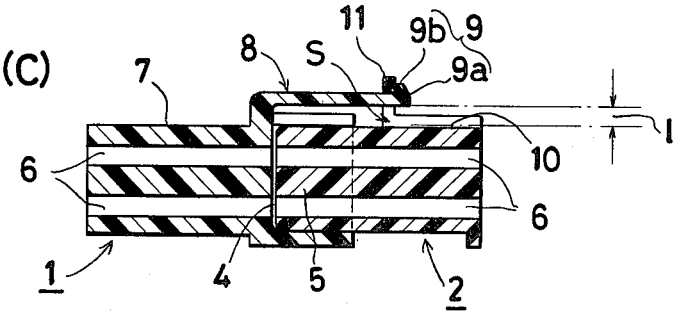

Now the procedure involved in bringing the two housings 1, 2 into mutual engagement will be described with reference to FIG. 3 and FIG. 4. First, as shown in FIG. 3(A), the leading end 5 of the male housing 2 is exactly opposed in the axial direction to the opening of the hollow portion 4 of the female housing 1 and then advanced into the hollow portion 4 (in the direction of the arrow A).

During this advance of the male housing 2, the check claw 9 at the leading end of the resilient tongue piece 8 collides with the front surface of the crosspiece 11. When the insertion is further continued from this condition, the abruptly inclined leading surface 9*a* of the check claw slides on the crosspiece and causes the resilient tongue piece 8 to be bent and the leading end thereof supporting the aforementioned check claw 9 to go down. Consequently, the check claw 9 is allowed to pass through the space "S" below the crosspiece 11 (as shown in FIG. 3(B)).

As the rear surface 9*b* of the check claw moves past the crosspiece 11, the resilient tongue piece 8 resumes its original shape owing to its own resiliency and the check claw 9 assumes its position behind the crosspiece 11 with the rear surface 9*b* thereof coming into contact with the crosspiece. This engagement between the crosspiece and the check claw brings the two housings into a fastened state, though not perfectly (FIG. 3(C) and FIG. 4).

The space "S" below the crosspiece is made large enough for the check claw 9 to pass under the crosspiece. In other words, the height of the crosspiece 11 must correspond to the height of the check claw so as to completely absorb the length "l" (vertical distance) with which the resilient tongue piece 8 carrying the check claw is bent downwardly.

Figure 4:
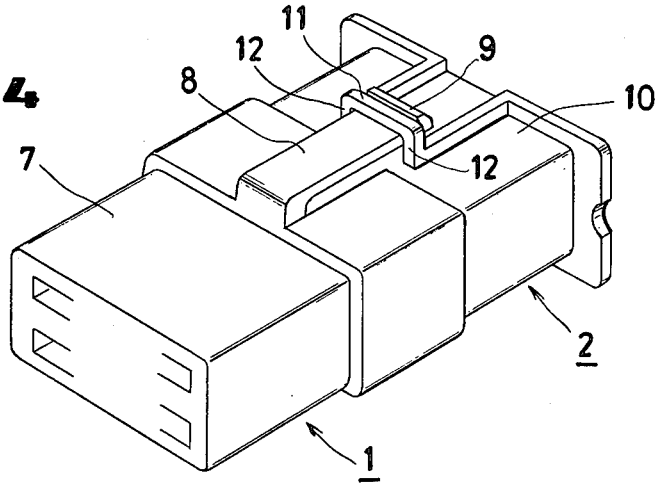
FIG. 4 is a perspective view illustrating the two connector housings in their fastened state.

As is plain from FIG. 3(C) and FIG. 4, after the two housings 1, 2 have been fastened to each other, namely after the two connector terminals "M", "F" (not shown) have been brought into electrical and mechanical union, the check claw 9 will not withdraw from the crosspiece 11 unless an external force is applied thereto because the resilient tongue piece 8 exerts its resiliency upwardly toward the crosspiece 11. As is clear from the explanation given above, however, a spatial allowance "l" for enabling at least the check claw 9 to be bent down and brought under the crosspiece remains between the lower surface of the resilient tongue piece and the upper surface 10 of the male housing 2 after the check claw and the crosspiece have been brought into mutual engagement. When the resilient tongue piece 8 is deliberately pushed down as with a finger tip, therefore, the snapping engagement established between the check claw 9 and the crosspiece 11 is broken and, in that condition, the two housings 1, 2 are ready to be pulled apart. This separability of the two housings has constituted one disadvantage for the conventional connector devices.

This invention, therefore, contemplates filling up the spatial allowance below the resilient tongue piece with a lock means 3 of a construction illustrated in FIG. 2, with a view to preventing the resilient tongue piece 8 from bending further in the downward direction.

Roughly, the lock means 3 comprises an insertion piece 13 adapted to be inserted into the spatial allowance formed below the resilient tongue piece after the two housings have been fastened to each other as illustrated in FIG. 3(C) and FIG. 4 and a check means 14 adapted to prevent the lock means itself from slipping out of the spatial allowance. In the present embodiment, the lock means further comprises a wall portion 15 adapted to hold in position the leading end of the check claw 9 and an auxiliary check means 16 adapted to prevent the lock means itself from producing otherwise possible sidewise play and add to the difficulty experienced during attempted separation of the lock means from the resilient tongue piece. The check means 14, 16 are so adapted that their inseparable engagement with the connector housing will be attained with respect to the support legs 12.

Now, the relation of the component parts of lock means 3 used in the present embodiment will be described. The insertion piece 13 which is inserted below the resilient tongue piece 8 is in the shape of a plate, and it is provided at the opposite sides of its leading end with a pair of check claw pieces 14 having the free ends thereof extended sidewise. From the rear end of the insertion piece 13, a wall portion 15 adapted to hold in position the leading end of the check claw 9 rises to a small height. From the opposite ends of this wall portion 15, arms 17 extend toward the leading end of the lock means 3. At the leading ends of the arms are formed a pair of inwardly pointed claws 16.

This lock means 3 is adapted to fulfill its function by having the insertion piece 13 inserted below the resilient tongue piece 8 after the two housings 1, 2 have been fastened to each other through the medium of the snapping engaging means 9, 11 as illustrated in FIG. 3(C) and FIG. 4. To clarify the condition under which the lock means 3 is engaged with the two support legs 12 of the crosspiece 11, the relation between the lock means 3 and the support legs 12 will be described with reference to FIG. 5 which illustrates the connection device minus the female housing.

As the lock means 3 is inserted in the direction of the leading end of the insertion piece 13 into the space below the crosspiece (in the direction of the arrow "B"), the check claw pieces 14 at the leading end collide with the two support legs 12 and, at the same time, the inwardly pointed check claws 16 disposed above the check claw pieces collide with the outer edges of the two support legs 12. When, in this condition, the lock means 3 is further inserted, the check claw pieces 14 at the leading end of the insertion piece 13 are bent inwardly toward each other and the inwardly pointed check claws 16 are bent outwardly in conjunction with the arms 17 away from each other and, thus, are allowed to pass the crosspiece 11 and the support legs 12. After the leading ends of the check means have ridden over the inner and outer sides of the support legs of the crosspiece, the check means resume their original shapes and come into inseparable engagement with the support legs in the direction opposite the direction of insertion as illustrated in FIG. 6. In this case, while the check claw pieces 14 at the leading end of the insertion piece 13 collide with the front surfaces of the support legs 12 and the upper, inwardly pointed check claws 16 similarly collide with the front surfaces of the support legs, they cooperatively assume a posture of embracing the support legs 12.

The attachment of the lock means 3 to the rest of the connector device is actually effected by having the insertion piece 13 slid under the resilient tongue piece 8. When this attachment is completed, therefore, the connector device assumes a state as illustrated in FIG. 6 and FIG. 7.

The insertion piece 13 of the lock means 3 assumes its position within the spatial allowance below the resilient tongue piece 8 of the snapping engagement means. An attempt to bend the resilient tongue piece 8 in the downward direction fails because of the obstruction offered by the insertion piece 13 lying thereunder. Separation of the two housings 1, 2 from each other is not attained unless and until this lock means 3 is removed from under the crosspiece. This lock means is unreturnably engaged with the engaging means represented by the support legs 12 through the medium of the check claw pieces 14 which are substantially wholly hidden under the resilient tongue piece. It is, therefore, substantially impossible to exert an external force for bending the check claw pieces 14 toward each other. From the design point of view, it is of course desirable to minimize the portions of the check claw pieces that protrude sidewise from the resilient tongue piece 8 as seen from above, namely, to adapt the opposite check claw pieces 14 so that their leading ends come into contact with the support legs at the positions as close to their respectively inner sides as permissible.

When the lock means is further provided, at the opposite ends of the wall portion 15 serving to hold down the top of the check claw 9, with auxiliary check claws 16 as in the present embodiment, these auxiliary check claws prevent the lock means itself from producing otherwise possible sidewise play. They further serve to foil an attempt to remove these check claws and the aforementioned check claws 14 simultaneously with one hand while holding the housing 1 or 2 in the other hand. Thus, separation of the lock means 3 from the engagement is not obtained without breaking the lock means 3, the resilient tongue piece 8 or the crosspiece 11.

The wall portion 15 of the lock means which holds down the top of the check claw 9 of the resilient tongue piece 8 fulfills a role of keeping the lock means itself from advancing beyond the fixed position of engagement. When a rib 18 adapted to keep in position the leading end of the insertion piece is provided as illustrated in FIG. 8, for example, no special use is found for the aforementioned wall portion 15. In the embodiment of FIG. 8, however, the wall portion 15 is retained as illustrated because it can be utilized for receiving the pressure exerted by the finger tip during the insertion of the lock means and, instead, the auxiliary check means 16 serving to embrace the support legs of the crosspiece are emitted. Besides, as the members for receiving into fast engagement the check pieces 14 provided on the insertion piece 13, engaging grooves 20 cut in the lateral ribs 19 which are additionally provided are used in the place of the support legs 12 of the crosspiece. Of course, the check claw pieces 14 may be received into grooves cut separately in the inner sides of the support legs of the crosspiece, for example. By such modification, the claws 14 can be completely isolated from the outside.

Further, the insertion piece 13 may be formed so that the upper and lower surfaces thereof will gradually approach toward each other in the direction of the leading end to have a wedge-shaped cross section as illustrated in the sectioned view of FIG. 7. This insertion piece can be inserted easily and, on completion of the insertion, imparts an energizing force upwardly to the resilient tongue piece 8. Consequently, it adds to the force with which all the parts of snapping engagement are brought into union. Since all the parts of snapping engagement come into tight contact with each other, they defy an attempted insertion of a tool for the purpose of removal.

As described above, this invention provides a connector device which permits two housings to be fastened, if tentatively, quite simply with the aid of snap-engaging means and, subsequently by the insertion of a lock means, enables the function of the device to retain the two housings in the fastened condition to be enhanced immensely, allows electric continuity between connector terminals to be maintained safely and securely and fulfills an additional function of sealing the two housings in their fastened state as occasion demands.

Optionally, a plurality of snap-engaging portions may be disposed at different points instead of just one such portion as used in the illustrated embodiment. In such case, although use of the lock means in only one of these snap-engaging portions may prove sufficient, it is also possible to use the lock means on each of the portions. On the female and male housings, the resilient tongue piece and the crosspiece may be disposed on the housings opposite those illustrated in the drawing. In the illustrated embodiment, the male and female housings are adapted so as to be joined telescopically to each other. Optionally, they may be adapted so as to be joined face to face to each other.

What is claimed is:

1. A connector device for electric circuits comprising a pair of female and male connector housings of insulating material, one of said connector housings being provided with a resilient tongue piece possessing a check claw at the leading free end thereof and the other connector housing being provided with a crosspiece adapted to be engaged with said check claw, whereby the union of the pair of connector housings and the consequent electrical connection of a pair of opposed conducting terminals incorporated one each within the connector housings are attained by bringing the connector housings into mutual contact, causing the check claw at the leading end of said resilient tongue piece to slide into a vacant space under said crosspiece and thereafter enabling the check claw to come into fast engagement with the crosspiece by virtue of the resiliency of said resilient tongue piece, which connector device further comprises a lock means provided with an insertion piece having an entering end adapted to be inserted into said vacant space below the resilient tongue piece after the connector housings have been fastened to each other and a check means adjacent said entering end adapted to engage stop means on one of said housings to bring said insertion piece into inseparable engagement with at least one of the connector housings.

2. A connector device for electric circuits comprising a pair of female and male connector housings of insulating material, one of said connector housings being provided with a resilient tongue piece possessing a check claw at the leading free end thereof and the other connector housing being provided with a crosspiece adapted to be engaged with said check claw, whereby the union of the pair of connector housings and the consequent electrical connection of a pair of opposed conducting terminals incorporated one each within the connector housings are attained by bringing the connector housings into mutual contact, causing the check claw at the leading end of said resilient tongue piece to slide into a vacant space under said crosspiece and thereafter enabling the check claw to come into fast engagement with the crosspiece by virtue of the resiliency of said resilient tongue piece, which connector device further comprises a lock means provided with an insertion piece adapted to be inserted into said vacant space below the resilient tongue piece after the connector housings have been fastened to each other and a check means adapted to bring said insertion piece into inseparable engagement with at least one of the connector housings, said check means comprising two pairs of claws adapted to be brought into inseparable engagement with support legs of the crosspiece.

3. The connector device according to claim 2, wherein one pair of claws of the two pairs of claws come into engagement with the corresponding support legs from the outer side thereof and the other pair of claws come into engagement with the support legs from the inner side thereof.

4. A connector device as set forth in claim 1 wherein said insertion piece has a pair of symmetrically disposed check means thereon.

5. A connector device as set forth in claim 1 or claim 4 wherein said check means comprises resilient means designed to snap into position and providing rearwardly directed shoulder means.

6. A connector device as set forth in claim 5 wherein each check means comprises a rearwardly and outwardly directed resilient strut.

7. A connector device as set forth in claim 1 wherein said check means engages stop means provided by notch means in one of said housings.

8. A connector device as set forth in claim 1 and further including a pair of legs supporting said cross-piece, at least one of said legs providing a stop engageable by said check means.

9. A connector device as set forth in claim 1 wherein said check means comprises at least one internal check and at least one external check.

10. A connector device as set forth in claim 9 wherein said insertion piece has adjacent the rear end thereof an upwardly directed wall positionable adjacent the free end of said resilient tongue piece, and a pair of arms extending forwardly from said wall, said check means comprising retaining means adjacent the forward ends of said arms.

11. A connector device as set forth in claim 1 and further including guide means on one of said housings guiding said insertion piece for rectilinear insertion.

12. A connector device as set forth in claim 11 wherein said insertion piece has a ramp movable into position beneath the free end of said tongue.

* * * * *